US005713150A

United States Patent [19]

Ealovega

[11] Patent Number: 5,713,150

[45] Date of Patent: Feb. 3, 1998

[54] COMBINED MECHANICAL AND ELECTRO-MECHANICAL FIRING MECHANISM FOR A FIREARM

[75] Inventor: George D. Ealovega, Kennebunk, Me.

[73] Assignee: Defense Technologies, LLC, Portland, Me.

[21] Appl. No.: 571,527

[22] Filed: Dec. 13, 1995

[51] Int. Cl.[6] ..... F41A 19/04

[52] U.S. Cl. ..... 42/84; 89/131; 89/142

[58] Field of Search ..... 42/84, 70.05, 69.03; 89/28.05, 28.1, 140, 144, 142, 149, 131

[56] References Cited

U.S. PATENT DOCUMENTS

| | | | |
|---|---|---|---|
| 507,823 | 10/1893 | Lott | 42/69.03 |
| 3,045,555 | 7/1962 | Stoner | 89/142 |
| 3,198,074 | 8/1965 | Perkins | 89/12 |
| 3,208,181 | 9/1965 | Calhoun et al. | 89/28.1 |
| 3,211,069 | 10/1965 | Rixton | 95/11.5 |
| 3,292,492 | 12/1966 | Sturtevant | 89/128 |
| 3,301,133 | 1/1967 | Sturtevant | 89/131 |
| 3,431,819 | 3/1969 | Koucky et al. | 89/145 |
| 3,650,174 | 3/1972 | Nelsen | 89/28.1 |
| 3,670,442 | 6/1972 | Kennedy et al. . | |
| 3,786,717 | 1/1974 | Vickers et al. | 89/1.814 |
| 3,854,231 | 12/1974 | Broyles | 42/84 |
| 3,886,792 | 6/1975 | Change et al. | 73/167 |
| 3,982,347 | 9/1976 | Brandl et al. | 42/84 |
| 3,997,817 | 12/1976 | Secker . | |
| 4,205,589 | 6/1980 | Engler et al. | 89/28.05 |
| 4,234,911 | 11/1980 | Faith | 362/111 |
| 4,248,386 | 2/1981 | Morle | 239/707 |
| 4,275,521 | 6/1981 | Gerstenberger et al. | 42/84 |
| 4,298,914 | 11/1981 | Long | 362/112 |
| 4,433,610 | 2/1984 | Tatro | 89/148 |
| 4,510,844 | 4/1985 | Fritz et al. | 89/135 |
| 4,522,105 | 6/1985 | Atchisson | 89/139 |
| 4,595,864 | 6/1986 | Stiefelmeyer et al. | 315/246 |
| 4,621,519 | 11/1986 | Phillips | 73/35 |
| 4,658,702 | 4/1987 | Tatro | 89/139 |
| 4,703,459 | 10/1987 | Bower | 367/25 |
| 4,727,670 | 3/1988 | Krouse | 42/69.01 |
| 4,744,416 | 5/1988 | Bower | 166/253 |
| 4,891,898 | 1/1990 | Houseman | 42/69 |
| 4,937,964 | 7/1990 | Crandall | 42/69 |
| 5,033,382 | 7/1991 | Webb | 102/235 |
| 5,083,392 | 1/1992 | Bookstaber | 42/84 |
| 5,183,959 | 2/1993 | McCoan et al. | 89/148 |
| 5,379,677 | 1/1995 | Ealovega et al. | 89/130 |

FOREIGN PATENT DOCUMENTS

| | | |
|---|---|---|
| 902696 | 12/1985 | Belgium . |

*Primary Examiner*—Michael J. Carone
*Assistant Examiner*—Christopher K. Montgomery
*Attorney, Agent, or Firm*—Perman & Green, LLP

[57] ABSTRACT

A firearm with a firing mechanism having a hammer, a trigger, a semi-automatic disconnector, an automatic sear, and an electro-mechanical movement mechanism for moving the automatic sear. The trigger and semi-automatic disconnector can be used to fire the firearm in a semi-automatic firing mode. The electro-mechanical movement mechanism can control release of the hammer by the automatic sear, but only after a first firing of the firearm by release of the hammer from a mechanical interlock with the trigger. The electro-mechanical movement mechanism has an actuator attached to a piezoelectric member. The piezoelectric member moves the actuator to move the automatic sear between a hammer holding position and a hammer release position.

24 Claims, 4 Drawing Sheets

COMBINED MECHANICAL AND ELECTRO-MECHANICAL FIRING MECHANISM FOR A FIREARM

BACKGROUND OF THE INVENTION

1. Field of the Invention

This invention relates to firearms and, more particularly, to a firing mechanism for a firearm.

2. Prior Art

U.S. Pat. Nos. 3,292,492; 3,301,133; and 5,183,959 disclose M16 styles of firearms that include a trigger with a sear abutment, a hammer with three sear surfaces, a disconnector movably mounted to the trigger, a selector switch, and an automatic sear. U.S. Pat. No. 5,379,677 discloses a mechanical rate control device. U.S. Pat. No. 4,275,521 discloses an electro-mechanical converter that uses a piezoelectric bending bar to move a latch from retaining a spring-loaded shot-triggering element. Other U.S. patents include the following:

| | |
|---|---|
| U.S. Pat. 3,045,555 | U.S. Pat. 3,198,074 |
| U.S. Pat. 3,211,069 | U.S. Pat. 3,431,819 |
| U.S. Pat. 3,670,442 | U.S. Pat. 3,886,792 |
| U.S. Pat. 3,982,347 | U.S. Pat. 3,997,817 |
| U.S. Pat. 4,234,911 | U.S. Pat. 4,248,386 |
| U.S. Pat. 4,433,610 | U.S. Pat. 4,510,844 |
| U.S. Pat. 4,522,105 | U.S. Pat. 4,595,864 |
| U.S. Pat. 4,621,519 | U.S. Pat. 4,658,702 |
| U.S. Pat. 4,891,898 | U.S. Pat. 4,937,964 |
| U.S. Pat. 4,703,459 | U.S. Pat. 4,744,416 |
| U.S. Pat. 5,033,382 | U.S. Pat. 5,083,392 |
| French Patent 902,696 | |

SUMMARY OF THE INVENTION

In accordance with one embodiment of the present invention a firearm mechanism is provided comprising a hammer, means for semi-automatic firing, and means for automatic firing. The means for semi-automatic firing has a trigger with a first sear abutment for engaging a first sear surface on the hammer and a disconnector. The disconnector is movably connected to the trigger and has a sear abutment for engaging a second sear surface on the hammer. The means for automatic firing has an electro-mechanically movable actuator. The actuator is for moving an automatic sear out of engagement with a third sear surface on the hammer. The automatic firing means is only operable after the trigger releases the hammer from mechanical engagement at the first sear surface.

In accordance with another embodiment of the present invention a firearm firing mechanism is provided comprising a hammer, an automatic sear, and an electro-mechanical movement mechanism for moving the automatic sear. The automatic sear has a first section for engaging a first sear surface on the hammer, a second section for movement by a selector, and a third section. The movement mechanism comprises an actuator and a piezoelectric member for moving the actuator. As the piezoelectric member is moved from a first position to a second position, the actuator is moved by the piezoelectric member to move the third section of the sear and thereby move the first section of the sear out of engagement with the sear surface on the hammer.

In accordance with one method of the present invention a method of firing a firearm is provided comprising steps of moving a trigger of the firearm to thereby release a mechanical interlock of the trigger with a hammer of the firearm, the release of the mechanical interlock allowing the hammer to move from a cocked position to a battery position to cause a first discharge of the firearm; retaining the hammer at its cocked position by a sear of the hammer when the hammer is moved back towards its cocked position after the first discharge; and moving the sear by an electro-mechanical mover from a holding position to a release position to thereby release the hammer from retainment by the sear, allowing the hammer to move to its battery position, and a causing a second subsequent discharge of the firearm wherein the first discharge is independent of electrical energy supplied to the electro-mechanical mover.

In accordance with another embodiment of the present invention in a firearm having a firing mechanism with a hammer, a trigger with a sear abutment for engaging a sear surface on the hammer to retain the hammer at a cocked position, a semi-automatic disconnector movably mounted to the trigger, and an automatic sear, the improvement comprises an electro-mechanical movement mechanism for moving the automatic sear from a hammer retaining position to a hammer release position.

In accordance with another method of the present invention a method of firing a firearm is provided comprising steps of providing the firearm with an electrical firing system; and preventing the electrical firing system from operating unless a fully mechanical trigger system of the firearm causes a first discharge of the firearm.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
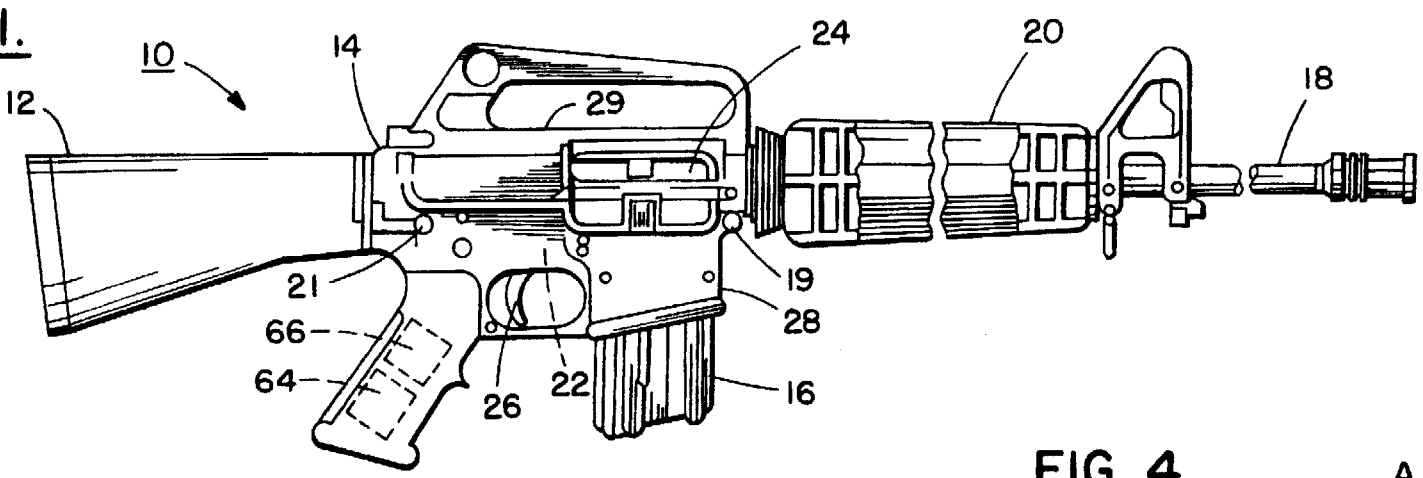
FIG. 1 is an elevational side view of a firearm incorporating features of the present invention.

Referring to FIG. 1, there is shown an elevational side view of a rifle 10 incorporating features of the present invention. The rifle 10 is similar in its exterior profile to an M16 type of rifle used by the United States Armed Forces.

Although the present invention is being described with the embodiment shown in FIG. 1, it should be understood that the present invention can be used with any gas operated or blow back type of firearm including pistols. In addition, it should also be understood that the present invention can incorporate any suitable size, shape, or type of elements and suitable type of materials without departing from the spirit of the invention.

In the embodiment shown in FIG. 1, the firearm 10 includes a stock 12 mounted on a receiver 14. The receiver 14 has a cartridge magazine 16 mounted therein. A barrel 18 is operatively connected to the receiver 14 and has a hand grip 20 mounted thereupon for isolating the hand of a shooter from direct contact with the barrel 18. The receiver 14 generally houses a firing mechanism 22 which generally includes a bolt assembly 24 and a trigger mechanism 26. The receiver 14 is generally comprised of metal and has a lower receiver 28 and an upper receiver 29 which are held together by two pins or screws 19 and 21. The lower receiver 28 generally houses the trigger mechanism 26 and the upper receiver 29 is generally provided with a longitudinal cavity or chamber into which the bolt assembly 24 is reciprocally mounted.

Figure 2A:
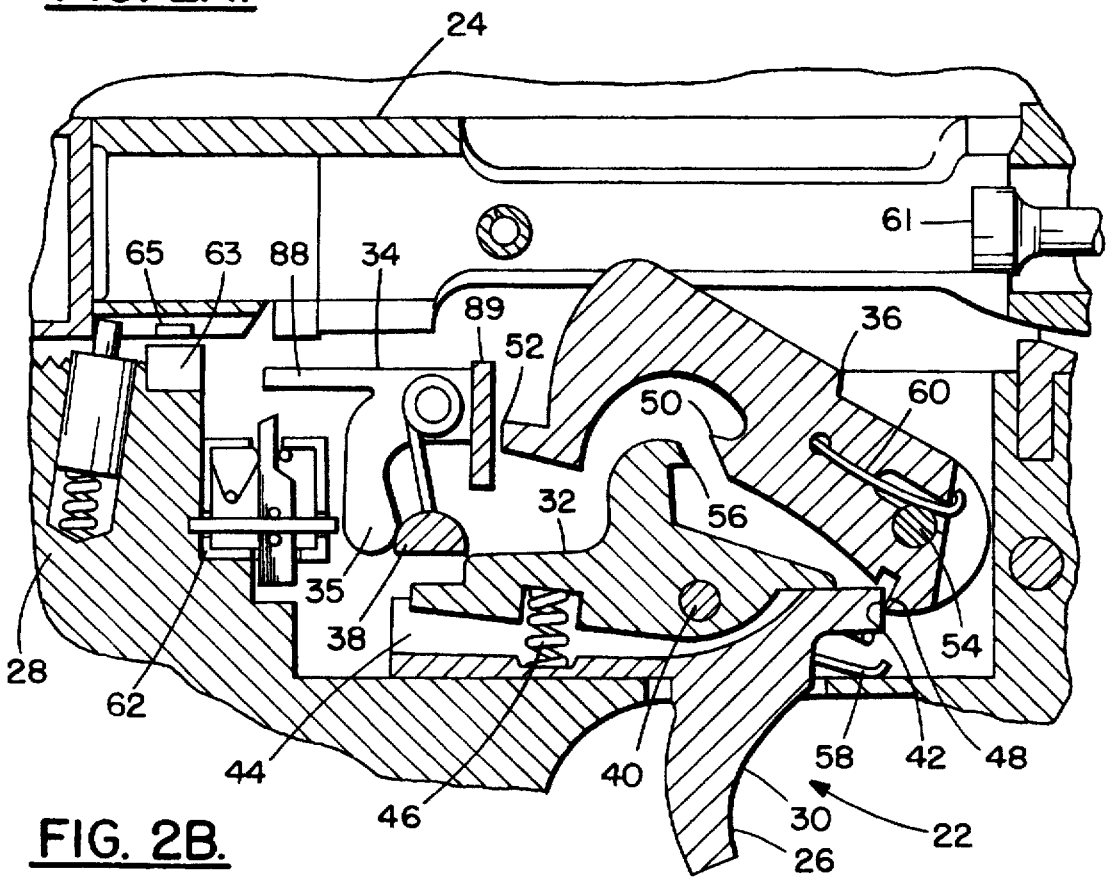
FIG. 2A is a cross-sectional view of a portion of the lower receiver and trigger mechanism of the firearm shown in FIG. 1.

Referring also to FIG. 2A, the trigger mechanism 26 is shown. The bolt assembly 24 is substantially identical to the bolt assembly in the M16 type of rifle except as described below. The trigger mechanism 26 includes a trigger 30, a disconnector 32, and an automatic sear 34. The trigger 30 and the disconnector 32 are identical to the trigger and disconnector in an M16 type of rifle. The firing mechanism 22 also includes a hammer 36 and a selector switch 38 which are also identical to the hammer and selector switch in an M16 type of rifle. When the selector switch 38 is set to a semi-automatic firing setting (see in FIGS. 2A and 2B), the trigger 30, disconnector 32 and hammer 36 function exactly the same as in an M16 type of rifle.

The trigger 30 is pivotally mounted within the lower receiver 28 by a transversely orientated pivot pin 40. The trigger 30 has an elongated upper portion which includes a forward trigger sear 42 adapted to retain the hammer 36. Additionally mounted on the pivot pin 40 is the disconnector 32. The lower portion of the disconnector 32 is located within a groove 44 in the upper portion of the trigger 30. A compression spring 46 is interposed between the bottom of the groove 44 and the underside of the disconnector 32 in order to urge the rear of the disconnector in an upward direction about the pivot pin 40. The hammer 36 is provided with a first sear abutment 48, a second sear abutment 50, and a third sear abutment 52. The hammer 36 is pivotally mounted to the lower receiver 28 at the pivot pin 54.

Figure 2B:
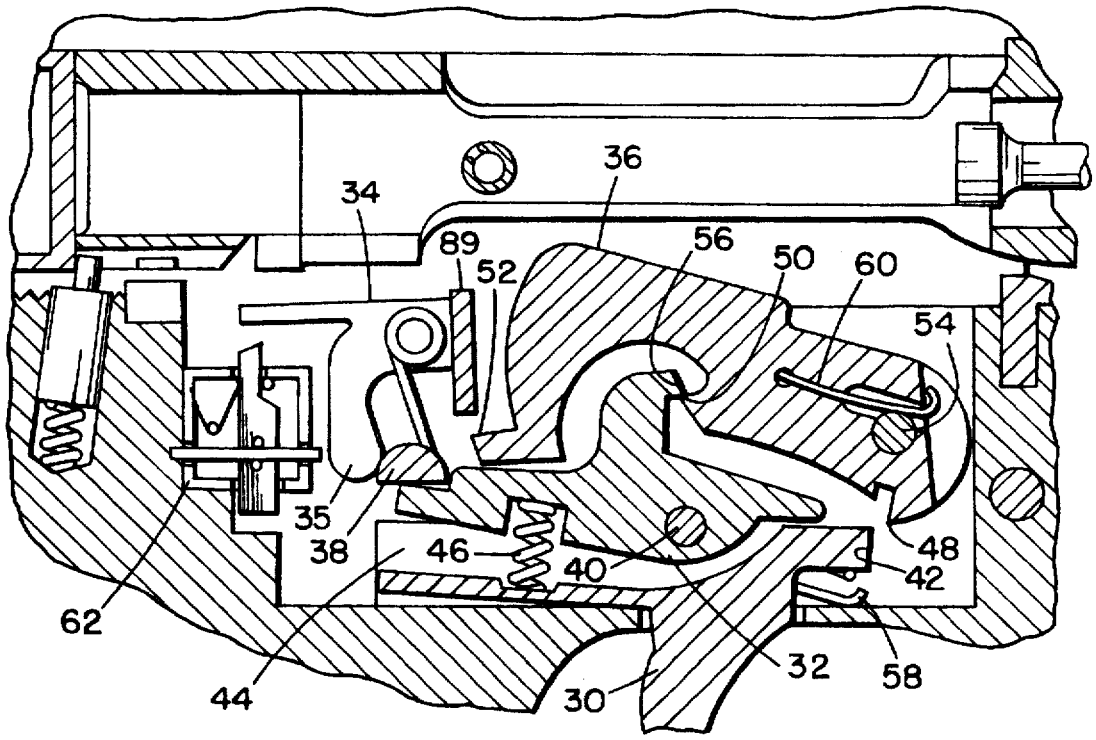
FIG. 2B is a cross-sectional view as in FIG. 2A showing the hammer being caught on the semi-automatic disconnector.

The disconnector 32 includes a vertically extending portion which includes a hook sear 56. The trigger 30, by virtue of its pivotal mounting on the pin 40, is adapted to pivot from a first position shown in FIG. 2A to a second position shown in FIGS. 2B and 2C. In the first position shown in FIG. 2A the trigger sear 42 is suitably located to engage the first sear abutment 48 and hold the hammer 36 in its cocked position shown. The selector switch 48 shown in FIG. 2A is set at a semi-automatic firing position. In this position the selector switch 38 allows the rear end of the disconnector 32 to move upward as shown in FIG. 2B. When the selector switch 38 is set to the semi-automatic position it also interacts with the automatic sear 34 to prevent the automatic sear from interacting with the hammer 36. The automatic sear 34 has a second section 35 that can be moved by the selector switch 38.

Upon rearward pivotable movement of the trigger 30 about its pivot pin 40, against the bias of the trigger spring 58, the trigger sear 42 moves down to thereby release the first sear abutment 48. The hammer 36 swings upwardly under the bias of a hammer spring 60 about its pivot pin 54. During upward swinging between its cocked position shown in FIG. 2A and a firing position or battery position in which the hammer 36 contacts the firing pin 61, the hammer 36 passes through a bottom longitudinal aperture or slot in the lower portion of the bolt assembly 24. Upon striking the firing pin 61 a chambered cartridge is fired. When the bolt assembly 24 recoils the hammer 36 is urged by the bolt assembly 24 in a downward or counterclockwise direction. Assuming that the trigger 30 has been retained in its depressed position shown in FIG. 2B during this downward movement, the second sear abutment 50 of the hammer 36 engages the hook sear 56 on the disconnector 32 after temporarily displacing the disconnector 32 in a counterclockwise direction about the pivot pin 40. Conversely, if the trigger 30 is immediately returned to its first position after firing of the chambered cartridge, the hammer 36 will be caught by the trigger sear 42 at the first sear abutment 48 to retain the hammer 36 back at its cocked position shown in FIG. 2A. After the hammer 36 is caught on the hook sear 56 the user must release the trigger 30 in order to fire the firearm again. When the user releases the trigger 30, the trigger sear 42 moves into a path in front of the first sear abutment 48. The trigger 30 also presses upward on the disconnector 32 at the front of the disconnector to thereby pivot the disconnector in a counterclockwise direction. As the disconnector 32 is rotated in a counterclockwise direction the hook sear 56 disengages from the second sear abutment 50 which releases the hammer 36 from the disconnector 32. The hammer 36 rotates upwards slightly but is held at its cocked position by engagement of the trigger sear 42 with the first sear abutment 48. The user can fire the firearm again by actuating the trigger 30 again.

The trigger 30, disconnector 32, hammer 36, and selector switch 38 are substantially identical and function substantially identically to the equivalent components in an M16 type firearm. The semi-automatic firing mechanism is entirely mechanically controlled by the trigger 30, disconnector 32, springs 46 and 58, and proper location of the selector switch 38. Thus, a user need only pull the trigger 30, in the semi-automatic mode, to release the hammer 36 from its cocked position to a battery position. Of course, in an alternate embodiment, a mechanical burst control mechanism could be incorporated with the trigger 30, disconnector 32, and hammer 36 to allow for multiple limited bursts of fire when the trigger 30 is actuated. In the embodiment shown, the automatic sear 34 is different than in the old M16 type firearms. In particular, the automatic sear 34 has a rear extension 88. In addition, its top 89 is configured such that it is not contacted and moved by the bolt assembly 24.

Figure 3:
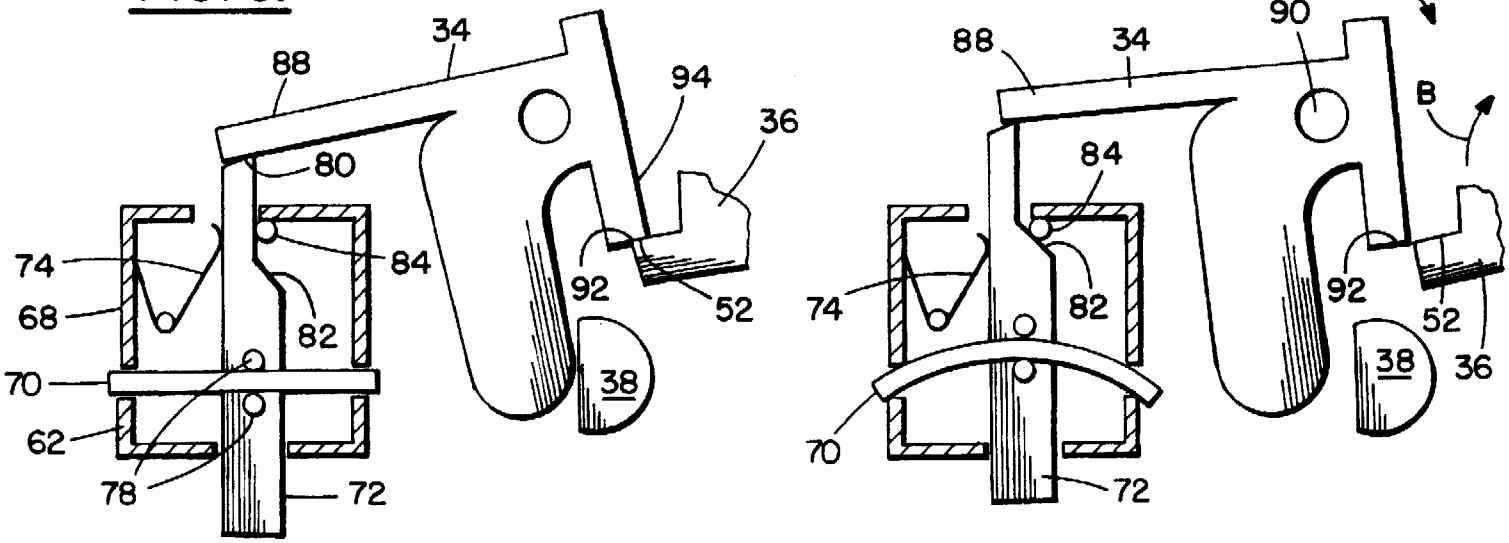
FIG. 3 is a schematic side view of the automatic sear, electro-mechanical movement mechanism and rear end of the hammer at the cocked position shown in FIG. 2C.
Figure 6:
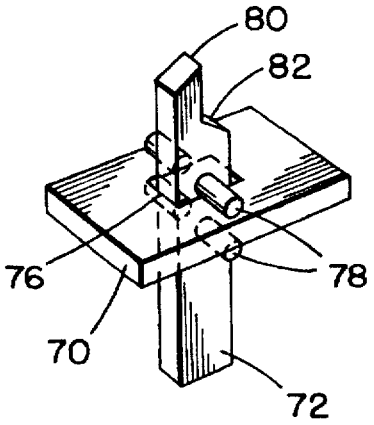
FIG. 6 is a perspective view of a portion of the electro-mechanical movement mechanism.
Figure 7:
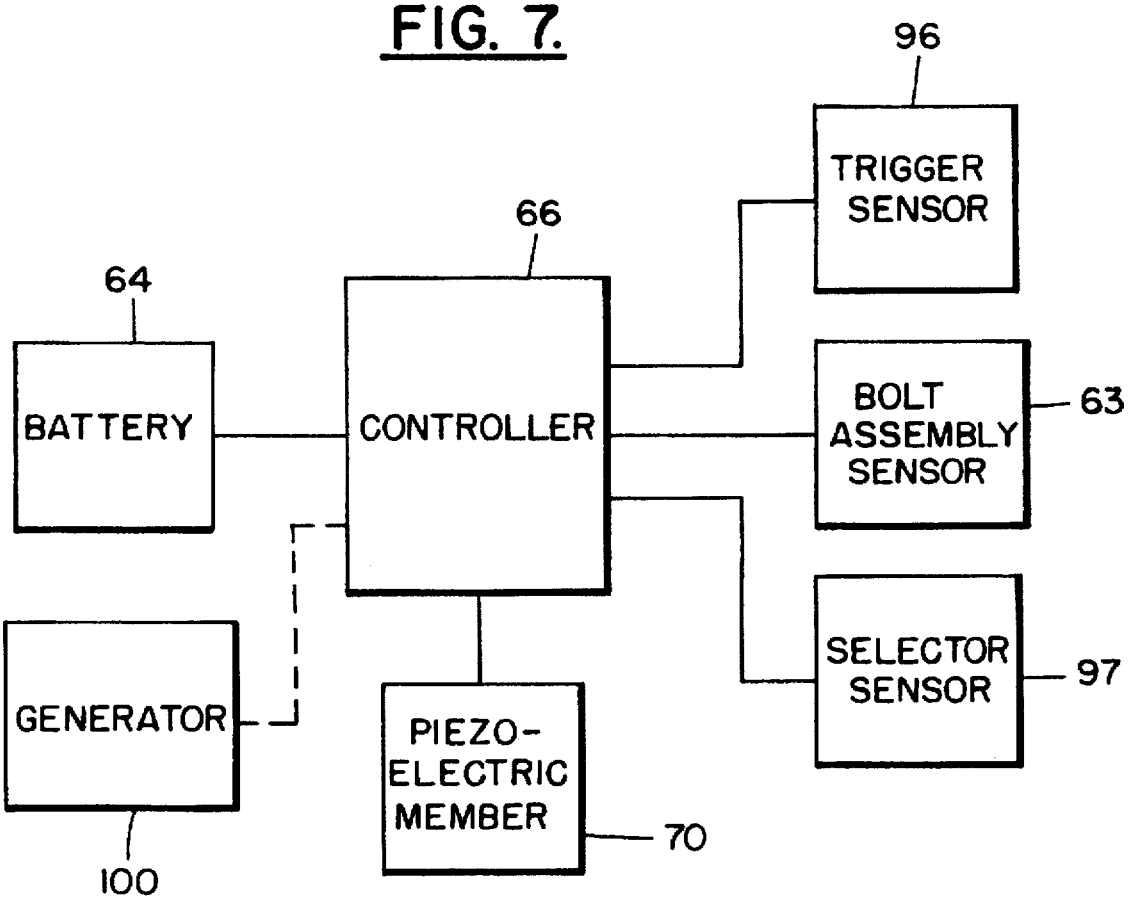
FIG. 7 is a block diagram of the electrical system used in the rifle shown in FIG. 1.

In the embodiment shown, the firing mechanism 22 also includes an electro-mechanical movement mechanism 62, a battery 64 (see FIG. 1) and a controller 66 (see FIG. 1). Referring also to FIGS. 3 and 6, the movement mechanism 62 includes a frame 68, a piezoelectric member 70, an actuator 72 and a spring 74. The movement mechanism 62 is generally located behind and underneath the automatic sear 34. The firing mechanism also includes a sensor 63 (see FIG. 2A) that is connected to the controller 66. A member 65, such as a magnet, is located on the bolt assembly 24 to actuate the sensor 63. However, in an alternate embodiment, a sensor need not be provided. Alternatively, any suitable type of sensor or switch could be used to indicate to the controller 66 that the bolt assembly 24 is at the battery position and/or that the bolt assembly 24 has cycled after firing of the firearm or previous actuation of the mechanism 62. Rather than sense the movement or position of the bolt assembly 24, the sensor could sense the location or movement of the hammer 36. The piezoelectric member 70 is generally flat in its uncharged state with an aperture 76 in its center. The piezoelectric member 70 is movably captured by slots in the frame 68 which still allow the member 70 to deflect when charged. In a preferred embodiment, the piezoelectric member is preferably comprised of material such as described in U.S. patent application Ser. No. 08/416,598, filed Apr. 4, 1995 entitled "Thin Layer Composite Unimorph Ferroelectric Drivers" which is hereby incorporated by reference. The actuator 72 extends through the aperture 76 and has pins 78 on both sides of the member 70. This mounts the actuator to the member 70, but allows the actuator to be pivotably moved relative to the member 70. The top of the actuator has a sear surface 80 and a ramp surface 82. The frame 68 includes a cam surface 84. The spring 74 biases the actuator 72 against the cam surface 84. The top of the actuator 72 extends through a hole in the frame 68 for making contact with the automatic sear 34. The piezoelectric member 70 is electrically connected to the battery 64 by means of the controller 66. The controller 66 preferably includes a microprocessor. In an alternate embodiment, any suitable type of controller could be provided. Referring also to FIG. 7, a block diagram of the electrical system used in the rifle 10 is shown. The sensors 63, 96, 97 are connected to the controller 66. The controller 66 controls the supply of electricity from the battery 64 to the piezoelectric member 70. The electrical system could also include a generator 100 for generating electricity, such as another piezoelectric member that is deformed by the bolt assembly to generate electricity. Generator 100 could also replace the battery 64. However, any suitable electrical system could be provided. The electro-mechanical automatic firing system of the above described embodiment could also be replaced with a different electrical firing system.

Figure 2C:
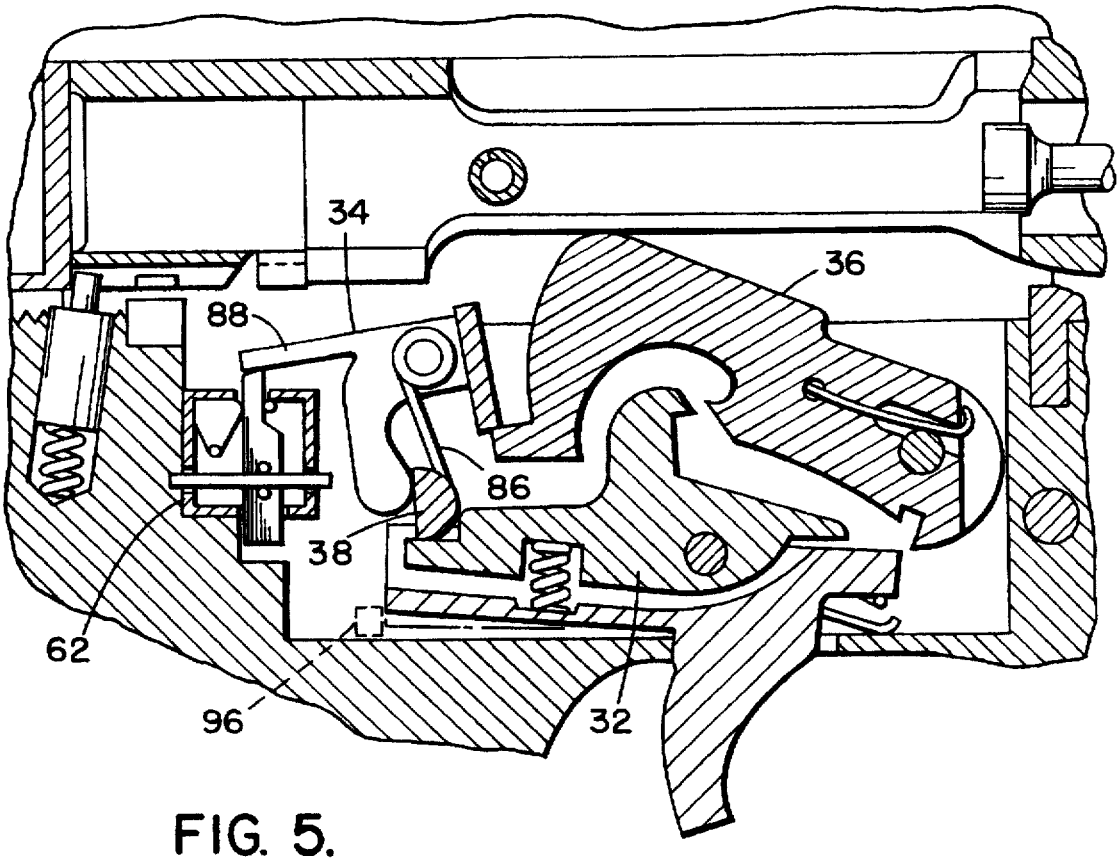
FIG. 2C is a cross-sectional view as in FIG. 2A showing the hammer being caught on the automatic sear.

As seen in FIGS. 2A and 2B, when the selector switch 38 is in its semi-automatic position, the switch 38 locates the automatic sear 34 out of the path of the third sear abutment 52 on the hammer 36. However, when the switch 38 is moved to the automatic position, as shown in FIG. 2C, the spring 86 biases the automatic sear 34 towards the hammer engaging position shown. The switch 38, when set to its automatic position, also keeps the semi-automatic disconnector 32 from engaging the hammer 36. FIG. 3 shows the movement mechanism 62 at a home position. In this home position the piezoelectric member 70 is uncharged and flat, the actuator 72 is in a down position, and the rear extension 88 rests on top of the sear surface 80. FIGS. 2A and 2B also show the movement mechanism 62 at its home position, but because the selector switch 38 locates the automatic sear 34 at a non-engaging position, the rear extension 88 does not contact the actuator 72.

Figure 4:
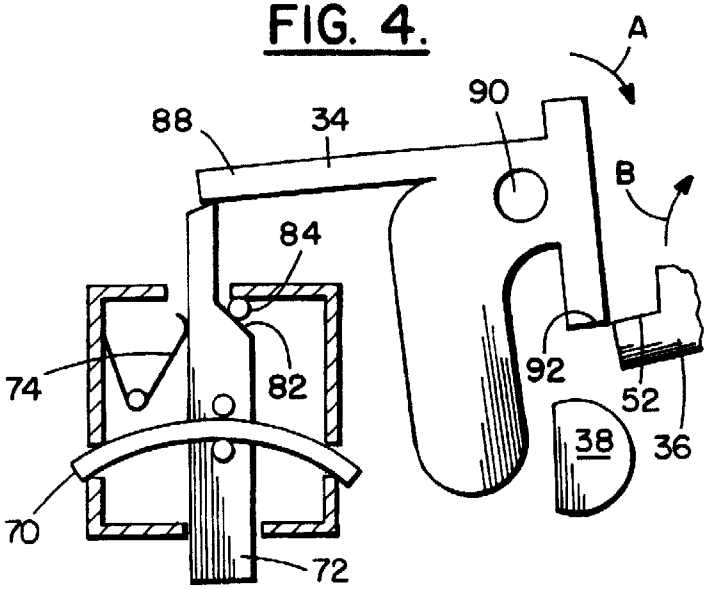
FIG. 4 is a schematic side view as in FIG. 3 with the automatic sear moved to a hammer release position.
Figure 5:
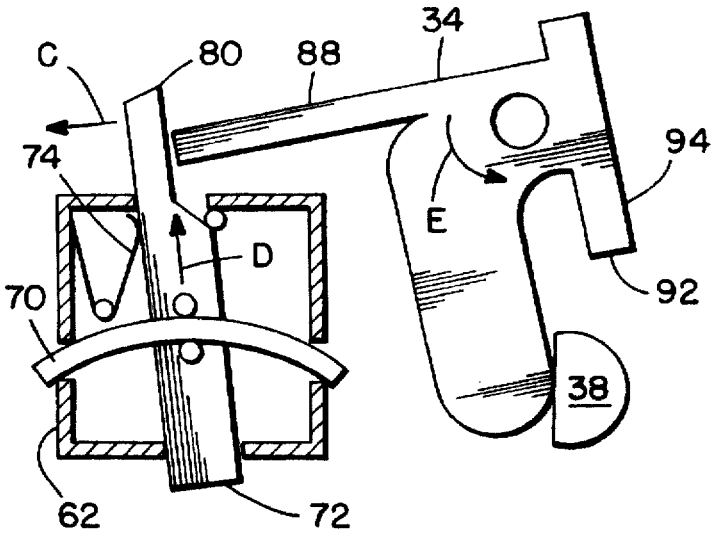
FIG. 5 is a schematic side view as in FIG. 4 with the automatic sear returned to its hammer retaining position when the electro-mechanical movement mechanism is moved to its fully extended position.

When the piezoelectric member 70 is energized by the controller 66, its center bends or deflects upward as shown in FIGS. 4 and 5. As the center is moved upwards, the actuator 72 is also moved upwards. As the actuator 72 moves upwards it moves the rear extension 88 upwards. This causes the automatic sear 34 to rotate on its mounting pin 90 as indicated by arrow A in FIG. 4. As shown in FIG. 4, after a predetermined amount of rotation of the sear 34, the sear surface 92 of the sear 34 is moved out of the path of the third sear abutment 52 on the hammer 36. The hammer 36 is able to swing upwards as indicated by arrow B from its cocked position shown in FIG. 3 to a battery position against the firing pin. As seen in comparing FIGS. 3 and 4, when the actuator 72 moves upward, the ramp surface 82 contacts the cam surface 84. Further upward movement of the actuator 72 causes the top of the actuator 72 to be pivoted rearwards with the spring 74 being compressed. As shown in FIG. 4, the sear surface 80 on the actuator 72 moves towards the rear of the rear extension 88 of the automatic sear 34. However, the sear surface 92 disengages from the third sear abutment 52 before the actuator 72 moves off of the rear extension 88.

Referring also to FIG. 5, the movement mechanism 62 is shown at its fully actuated position. In this position the piezoelectric member 70 is at its fully bent shape. The top of the actuator 72 has been moved, as indicated by arrows C and D, to its fully upward and rearward position. In this position the sear surface 80 has moved out from underneath the rear extension 88 of the automatic sear 34. This allows the spring 86 (see FIG. 2C) to rotate the automatic sear 34 back to its hammer engaging position as indicated by arrow E. The actuator 72 disengages from the automatic sear 34 to prevent an unregulated burst of automatic fire; to insure that the sear 34 returns to its hammer retaining position. The controller 66 then stops the supply of electricity to the piezoelectric member 70. This causes the member 70 to return to its flat shape shown in FIG. 3. The member 70 pulls the actuator 72 back down and the spring 74 helps to bias the actuator 72 back towards its position shown in FIG. 3. When the hammer 36 recoils after it strikes the firing pin, it rotates the automatic sear 34 as it passes along surface 94 opposite to direction E. This moves the rear extension 88 upwards to allow the spring 74 to push the sear surface 80 under the extension 88. The sear 34 snaps back into the position shown in FIG. 3 when the third sear abutment 52 moves below the sear surface 92. When the controller 66 actuates the movement mechanism 62 again, the process is repeated. In an alternate embodiment any suitable type of electro-mechanical or electrical automatic firing system could be provided. Each and every discharge caused by the electro-mechanical trigger mechanism, is dependent on the mechanical cycling of the firearm. One mechanical cycling causes one activation of the electro-mechanical trigger mechanism, which in turn results in only one discharge. This link between the mechanical and the electro-mechanical systems was specifically designed to ensure that the two systems remain synchronized. Proper synchronization prevents unexpected, un-regulated high bursts of fire, which could otherwise cause sudden and dangerous weapon climb, or could result in a lock-up of components, ceasing fire altogether. A hammer which is not sear released, but simply rides up behind the bolt, may not have the necessary energy left to cause a successful primer detonation, and will cause a misfire.

In the embodiment and method described above, it is noted that, with the selector switch 38 set to an automatic or a burst setting, the first release of the hammer 36 from a cocked position is a purely mechanical process of the trigger sear 42 moving out of the path of the first sear abutment 48. This is the same as with known M16 types of firearms. However, unlike known M16 types of firearms, the control of subsequent releases of the hammer 36 in a burst of automatic firing (i.e.: more than one firing from a single trigger actuation) is not purely mechanically controlled. In the rifle 10 subsequent releases of the hammer 36 after a first release and in an automatic and/or burst mode is electro-mechanically controlled. With this type of embodiment the rate of fire of the rifle 10 can be selected and controlled, such as preprogramming the controller 66 to cyclically charge and stop charging the piezoelectric member 70 at a rate of 450 times a minute for a firing rate of 450 rounds per minute.

Of course the manufacturer of the rifle could select any suitable rate. Thus, the controller 66 can move the member 70 and actuator 72 after a predetermined period of time or preset delay, such as every 1/450 of a minute. Preferably, the predetermined period of time is measured from an occurrence of a predetermined event, such as return of the bolt assembly 24 to its battery position.

Figure 8:
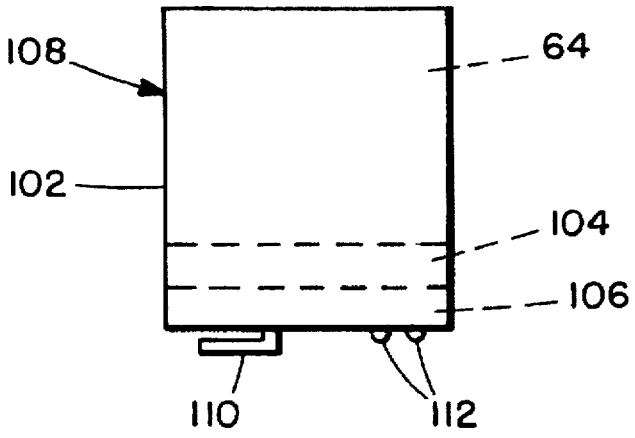
FIG. 8 is a schematic side view of a type of battery assembly for use with the rifle shown in FIG. 1.

Referring also to FIG. 8, the battery 64 could be housed in a container 102 which includes multiple reserve batteries 104, 106 as an assembly 108. The whole unit 108 could be designed to be sealed against the elements and replaceable as a complete package. In the event of a battery failure, one would simply activate a manual selector device 110 which would disengage the circuit from the failed main battery 64 and engage the circuit to one of the fresh reserve batteries 104, 106. Included could be some form of visual indicators 112, such as LEDs, which would indicate the actual condition of any of the batteries. With such an improvement, the soldier could engage a fresh battery supply at the push of a switch, allowing immediate resumption of full-auto firing, and replace the whole battery unit 108 at a time when conditions were more favorable.

Purely mechanical automatic firing mechanisms in old M16 type firearms typically have a rate of fire of about 600–700 rounds per minute and about 900 rounds per minute for shorter barrel carbines. These high rates can result in a large waste of ammunition. However, it is impractical to design a fully mechanical automatic firing mechanism with lower rates of fire. Organizations that already have M16 type firearms also desire to purchase similar new firearms for reasons such as ease and uniformity of training and maintenance. An electrically controlled system, on the other hand, allows rates of fire to be easily selected and/or adjusted. Thus, unlike the fully mechanical automatic firing mechanism of the old M16 type firearms that had a rate of fire not below about 600 rounds per minute, the rifle 10 can provide any suitable rate of fire such as 300, 400, 500, etc. round per minute. This is especially useful for M16 type rifles with short barrels. For these short barrel rifles the firing rate can be reduced 50% or more. Obviously, this can save a large amount of ammunition. The reduced rate of fire also helps to eliminate muzzle climb that is associated with most handheld firearms when discharged in an automatic mode. Climb occurs when an excessively high cyclic rate does not allow sufficient time for the weapon to return to its original point of aim between successive discharges. The string of shots progressively "climbs" away from the original point of aim and moves off target. The present invention helps to eliminate climb. The controller 66 could also be preprogrammed to fire only a burst, such as two or three rounds, before stopping the charging of the member 70 until the trigger 30 is released. A suitable trigger sensor 96 could be connected to the controller 66 to signal release of the trigger 30 by the user. Such an arrangement could do away with the mechanical burst mechanism. A sensor or switch (not shown) could also be connected to the selector switch 38 to signal the controller 66 or connect the controller to the battery 64 when the switch 38 is set to the automatic firing setting. The controller 66 could be preprogrammed or otherwise configured not to actuate the mechanism 62, even if the bolt assembly 24, is reciprocally cycled, unless the switch 38 is set to an automatic setting. This could be used to help conserve battery life when the rifle is fired in a semi-automatic mode.

The present invention is a marriage of two separate trigger mechanisms, with some functions causing the two mechanisms to be interdependent, and others not. One trigger mechanism is fully mechanical, and in this description it is the M16 trigger mechanism as previously described. The second mechanism is an electro-mechanical trigger mechanism. The fully mechanical trigger mechanism is at all times responsible for the first discharge of an individual burst in any mode of fire selected. The electro-mechanical trigger mechanism is responsible for the second and all subsequent discharges in a burst or fully automatic firing modes, but the electro-mechanical trigger mechanism is always dependent on the fully mechanical trigger mechanism to cause the first discharge of any individual burst of fire. The fully mechanical trigger mechanism is independent of the electro-mechanical trigger mechanism. Should the battery or any other component in the electro-mechanical trigger mechanism fail, by simply positioning the selector switch to a semi-automatic setting, the soldier can continue to fire his weapon by employing the independent fully mechanical trigger mechanism. The present invention insures that a first round will be fired from the firearm regardless of the setting of the selector switch. Thus, even if the electrical system is not operating, actuating the trigger with the selector switch set to an automatic setting will nonetheless result in a round being fired. If the electrical system is operating properly, the electro-mechanical firing system is still dependent upon the fully mechanical trigger mechanism to cause the first discharge. For an electrical or electro-mechanical firing system a primary concern is that, in the event of a battery failure in a combat situation, the soldier would not have a functioning firearm until the soldier replaced the battery. The present invention overcomes this concern. One of the significant advantages of the present invention is in regard to a fail-safe to allow the rifle 10 to be fired. In the event the mechanism 62 fails to function, such as if the battery 64 fails, the user can merely move the selector switch 38 to the semi-automatic setting. The rifle 10 can still be used in a semi-automatic mode because the semi-automatic firing mechanism is purely mechanically controlled; not electrically controlled. Therefore, the present invention provides both the reduced rate of fire from an electrically controlled system and a reliable mechanically controlled system in the event of a power failure to the electrically controlled system. By retaining the fully mechanical trigger mechanism, a heavy trigger pull can be retained, the proven mechanical safety of the mechanical trigger mechanism is retained, concern over electrical system failure causing the weapon to accidentally fire is eliminated and concern over de-synchronization of the electrical control is virtually eliminated. In addition, concern of a reduced battery life from a soldier constantly pulling a trigger of an unloaded weapon just for fun to hear a "click, click, click" sound is prevented because the electrical system will only start to work after a first discharge of the firearm. The present invention allows use of pre-existing firing mechanism components of M16 rifles to be used. Only the old full automatic sear needs to be replaced. The remaining old components can remain the same; only new components are added. Thus, design, testing, evaluation and re-tooling will be relatively inexpensive when compared to a weapon with a totally new firing system.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A firearm firing mechanism comprising:

a hammer;

means for semi-automatic firing having a trigger with a first sear for engaging a first sear surface on the hammer and a disconnector movably connected to the trigger, the disconnector having a second sear for engaging a second sear surface on the hammer; and means for automatic firing having an electro-mechanical movement mechanism for moving an automatic sear out of engagement with a third sear surface on the hammer wherein the automatic firing means is only operable after the trigger releases the hammer from mechanical engagement at the first sear surface.

2. A firearm firing mechanism as in claim 1 wherein the electro-mechanical movement mechanism comprises a piezoelectric member connected to an actuator.

3. A firearm firing mechanism as in claim 2 wherein the piezoelectric member has a substantially flat shape in an uncharged state with an aperture therethrough and the actuator passing through the aperture.

4. A firearm firing mechanism as in claim 3 wherein the actuator is pivotally connected to the piezoelectric member.

5. A firearm firing mechanism as in claim 4 wherein the movement mechanism further comprises a cam and a spring, the spring biasing the actuator towards the cam and the cam engaging a cam surface on the actuator when the actuator is moved by the piezoelectric member towards an automatic sear release position.

6. A firearm firing mechanism comprising:

a hammer;

an automatic sear having a first section for engaging a sear surface on the hammer, a second section for movement by a selector, and a third section; and an electro-mechanical movement mechanism for moving the automatic sear, the movement mechanism comprising an actuator and a piezoelectric member for moving the actuator, wherein as the piezoelectric member is moved from a first position to a second position the actuator is moved by the piezoelectric member to move the third section of the sear and thereby move the first section of the sear out of engagement with the sear surface on the hammer.

7. A firearm firing mechanism as in claim 6 further comprising a semi-automatic firing system comprising a trigger with a first sear and a disconnector movably connected to the trigger with a second sear.

8. A firearm firing mechanism as in claim 7 further comprising means for allowing the firing mechanism to operate only after mechanical release of the hammer from the trigger at the first sear.

9. A firearm firing mechanism as in claim 6 wherein the piezoelectric member has a substantially flat shape in an uncharged state with the actuator passing through its center.

10. A firearm firing mechanism as in claim 9 wherein the actuator is pivotally connected to the piezoelectric member.

11. A firearm firing mechanism as in claim 6 further comprising a cam and a spring, the spring biasing the actuator towards the cam and the cam engaging a cam surface on the actuator when the actuator is moved by the piezoelectric member towards an automatic sear release position.

12. A method of firing a firearm comprising the steps of:

moving a trigger of the firearm to thereby release a mechanical interlock of the trigger with a hammer of the firearm, the release of the mechanical interlock allowing the hammer to move from a first cocked position to a battery position to cause a first discharge of the firearm;

retaining the hammer at a second cocked position by a sear of the firearm when the hammer is moved back from its battery position after the first discharge; and moving the sear by an electro-mechanical mover from a holding position to a release position to thereby release the hammer from retainment by the sear, allowing the hammer to move back to its battery position, and causing a second subsequent discharge of the firearm wherein the first discharge is independent of electrical energy supplied to the electro-mechanical mover.

13. A method as in claim 12 further comprising releasing the sear from the mover after the sear releases the hammer, the sear being biased back to its holding position by a spring.

14. A method as in claim 12 wherein the step of moving the sear comprises a controller moving the mover from the holding position to the release position after a predetermined period of time.

15. A method as in claim 14 wherein the predetermined period of time is measured from an occurrence of a predetermined event.

16. In a firearm having a firing mechanism with a hammer, a trigger with a trigger sear for engaging a sear surface on the hammer to retain the hammer at a cocked position, an automatic sear, and a semi-automatic sear, the improvement comprising:

an electro-mechanical movement mechanism for moving the automatic sear from a hammer retaining position to a hammer release ion, wherein the movement mechanism does not affect operation of the semi-automatic sear.

17. A firearm as in claim 16 wherein the electro-mechanical movement mechanism comprises a piezoelectric member connected to an actuator.

18. A firearm as in claim 17 wherein the piezoelectric member has a substantially flat shape in an uncharged state with the actuator passing through a center of the piezoelectric member.

19. A firearm as in claim 18 wherein the actuator is pivotally connected to the piezoelectric member.

20. A firearm as in claim 19 wherein the electro-mechanical movement mechanism further comprises a cam and a spring, the spring biasing the actuator towards the cam and the cam engaging a cam surface on the actuator when the actuator is moved by the piezoelectric member towards a hammer release position to move the actuator away from the automatic sear.

21. A firearm as in claim 16 further comprising a battery assembly electrically connected to the electro-mechanical movement mechanism, the assembly having multiple batteries and a switch to switch electrical connection of the batteries with the movement mechanism.

22. A firearm as in claim 16 further comprising an electrical generator connected to the electro-mechanical movement mechanism.

23. A firearm as in claim 22 wherein the generator comprises a piezoelectric member that is deformed by movement of a portion of the firing mechanism after the firearm is fired to supply electricity to the firing mechanism.

24. A method of firing a firearm comprising steps of:

providing the firearm with an electrical firing system; and preventing the electrical firing system from operating unless a solely mechanical trigger system of the firearm releases a hammer which strikes a firing pin and causes a first discharge of the firearm.

* * * * *